US005639315A

United States Patent [19]

Takashima et al.

[11] Patent Number: 5,639,315

[45] Date of Patent: Jun. 17, 1997

[54] PROCESS FOR PRODUCING NON-ORIENTED ELECTROMAGNETIC STEEL STRIP CAPABLE OF RETAINING UNIFORM MAGNETIC QUALITY IN A PRODUCT COIL

[75] Inventors: Minoru Takashima; Keiji Sato; Takashi Obara, all of Okayama, Japan

[73] Assignee: Kawasaki Steel Corporation, Japan

[21] Appl. No.: 573,277

[22] Filed: Dec. 15, 1995

[30] Foreign Application Priority Data

Dec. 20, 1994 [JP] Japan ..... 6-334646

[51] Int. Cl.[6] ..... H01F 1/14

[52] U.S. Cl. ..... 148/120; 148/111

[58] Field of Search ..... 148/111, 120

[56] References Cited

FOREIGN PATENT DOCUMENTS 0201744 11/1986 European Pat. Off. .
0263413 4/1988 European Pat. Off. .
2202943 5/1974 France .
51-074923 6/1976 Japan .

*Primary Examiner*—John Sheehan
*Attorney, Agent, or Firm*—Austin R. Miller

[57] ABSTRACT

A process is disclosed for the production of a non-oriented electromagnetic steel strip having its magnetic characteristics uniformly retained in the product coil. The process involves by full- or semi-processing, hot rolling a steel slab containing not more than about 0.03% by weight of C, not more than about 3% by weight of Si and not more than about 2% by weight of Al such that the equation [Si wt %]+3 [Al wt %]−6 [C wt %] is in the range of about 0 to 2; and cold rolling the hot rolled steel strip in a known manner, followed optionally by finish annealing and also optionally by skin-pass rolling. The coil is finish rolled at a peripheral roll speed between about 500 to 1,500 mpm at the final stand. The peripheral roll speed at the final finish rolling stand is also controlled within a range of no more than about 300 mpm. Hot rolling is completed at a temperature Tf (° C.) in an alpha-phase temperature zone and not less than about {750+30 ([Si wt %]+3 [Al wt %]−6 [C wt %])}.

6 Claims, 7 Drawing Sheets

(a)

(b)

PROCESS FOR PRODUCING NON-ORIENTED ELECTROMAGNETIC STEEL STRIP CAPABLE OF RETAINING UNIFORM MAGNETIC QUALITY IN A PRODUCT COIL

BACKGROUND OF THE INVENTION

1. Field of the Invention

This invention relates to a process for producing a non-oriented electromagnetic steel strip that has enhanced magnetic qualities and can retain these qualities in a uniform or regular condition in a product coil.

2. Description of the Related Art

Non-oriented electromagnetic steel strips are well-suited as core material for motors, generators and transformers. To increase energy efficiency, non-oriented electromagnetic steel strips should exhibit excellent magnetic characteristics, i.e. low iron loss and high magnetic flux density.

Magnetic characteristics can be improved by modifying the aggregate structure of the corresponding product steel strip, i.e., by decreasing (111)-oriented crystal grains and by increasing (100)-oriented crystal grains. As is well known in the art, the metallic structure of a hot-rolled steel strip has a major effect on the aggregate structure of the resulting product steel strip. As a result, it has been widely recognized that non-oriented electromagnetic steel strip varies in magnetic qualities depending upon the temperatures at which hot rolling is completed and at which hot-rolled steel strip take-up is conducted. These temperature parameters are closely associated with the metallic structure of a hot-rolled steel strip, which in turn strongly influences the aggregate structure of a product steel strip.

With a view to improving the magnetic quality of electromagnetic steel strip, Japanese Patent Laid-Open (Unexamined) Publication No. 51-74923 utilizes the above-described relationships. This publication discloses a method which calculates a transformation point $A_3$ from the equation $$A_3=\{820+30([\text{Si wt }\%]+3[\text{Al wt }\%]-6\,[\text{C wt }\%])\}^\circ\text{ C}$$

and, at the same time, completes finish-hot rolling between a temperature calculated from the equation $$\{750+30\,([\text{Si wt }\%]+3[\text{Al wt }\%]-6[\text{C wt }\%])\}^\circ\text{ C.}$$

and a temperature calculated from the equation $$\{810+30([\text{Si wt }\%]+3[\text{Al wt }\%]-6[\text{C wt }\%])\}^\circ\text{ C.}$$

whereby an electromagnetic steel strip is produced having good magnetic quality, low silicon content and minimal thickness irregularity.

However, even when hot rolling is completed within the temperature range proposed by that publication, the resultant product possesses a magnetic flux density ($B_{40}$) of 1.72 ($Wb/m^2$), which is only marginally better than the 1.71 ($Wb/m^2$) achievable through conventional methods.

To further improve magnetic quality in an electromagnetic steel strip, Japanese Patent Laid-Open (Unexamined) Publication No. 56-38420 computes transformation points $Ar_3$ and $Ar_1$ from the equations $$Ar_3=\{891-90(\text{C }\%)+50(\text{Si }\%)-88(\text{Mn }\%)+190(\text{P }\%)+380(\text{Al }\%)\}^\circ\text{ C.}$$

and $$Ar_1=\{882-5{,}750(\text{C }\%)+58{,}800(\text{C }\%)2+50(\text{Si }\%)-82\text{Mn }\%)+170(\text{P }\%)+380(\text{Al }\%)\}^\circ\text{ C.,}$$

thereby completing hot rolling at a temperature lower than $(Ar_3+Ar_1)/2$ and higher than 750° C. and also performing take-up at a temperature above 680° C. The high take-up temperature, however, results in the formation of thick scales on the hot-rolled steel strip. Removal of the scales requires extensive pickling, thereby sharply increasing production cost.

Motors having integrated circuits (ICs) built therein have become commonplace. Such motors require precise controllability; thus, irregularities between like motors must be kept at an absolute minimum. As a result, a strong demand has arisen for a non-oriented electromagnetic steel strip which not only exhibits excellent magnetic quality, but also uniformly retains its magnetic quality in the product coil.

The foregoing prior art publications do not consider the uniform retention of magnetic quality in the product coil at all. Where a hot-rolled steel strip is taken up at above 680° C. as taught by Japanese Patent Laid-Open (Unexamined) Publication No. 56-38420, a product coil fabricated from the steel strip is cooled such that the outer and inner portions of the strip are exposed to two considerably different temperatures. Consequently, the magnetic qualities of the product coil become irregular throughout the coil, thereby destroying the core uniformity demanded in motors having ICs.

OBJECTS OF THE INVENTION

It is an object of the invention to provide a process for producing a non-oriented electromagnetic steel strip which has excellent magnetic quality and enables uniform retention of the magnetic quality in a product coil. This and other objects, advantages and features of the invention will be apparent from the following description taken in conjunction with the accompanying drawings.

SUMMARY OF THE INVENTION

In view of the above-described industry demands and prior art shortcomings, the present invention is based upon discoveries resulting from continued research on the metallic structure of hot-rolled steel strips and on the magnetic qualities of resulting products, particularly regarding the relationship between rolling conditions and rolling temperatures at the time of hot rolling.

According to one aspect of the invention, there is provided a process for the production of a non-oriented electromagnetic steel strip capable of uniformly retaining magnetic characteristics in a product coil. By full- or semi-processing, the process involves hot rolling a steel slab containing not more than about 0.03% by weight of C, not more than about 3% by weight of Si and not more than about 2% by weight of Al such that the equation [Si wt %]+3 [Al wt %]−6 [C wt %] is in the range of about 0 to 2; then cold rolling the hot-rolled steel strip in a known manner, followed optionally by finish annealing and also optionally by skin-pass rolling. The hot rolling is conducted such that, for each coil at the final stand during finish rolling, the peripheral roll speed is between about 500 to 1,500 mpm. Further, the peripheral roll speed is controlled within a range no greater than about 300 mpm. Hot rolling is completed at a temperature Tf (° C.) which is in an alpha-phase temperature zone and not less than about {750+30 ([Si wt %]+3 [Al wt %]−6 [C wt %])}.

According to another aspect of the invention, there is provided a process for the production of a non-oriented electromagnetic steel strip as described above, wherein hot rolling is completed at a temperature Tf (° C.) not less than about {750+30 ([Si wt %]+3 [Al wt %]−6 [C wt %])} and not more than about {810+30 ([Si wt %]+3 [Al wt %]−6 [C wt %])}.

DETAILED DESCRIPTION OF THE INVENTION

The present invention was discovered through the following investigations.

On the presumption that magnetic quality would vary depending upon hot-rolling conditions, we closely studied the effects of hot-rolling conditions on the irregularity of magnetic quality in a coil. We discovered that the irregularities correlated with the rolling speeds at the time of finish rolling. Details of the experiments and results are explained below.

A steel slab, comprising 0.003% by weight of C, 0.3% by weight of Si, 0.15% by weight of Mn and 0.2% by weight of Al, was heated at 1,150° C. and hot rolled into a 2.0 mm hot-rolled steel strip. Hot rolling was carried out in conventional fashion by coarse rolling 6 times and by finish rolling on a tandem mill comprised of 7 stands. Hot rolling was concluded at 800° C., and take-up was effected at 550° C.

Figure 1:
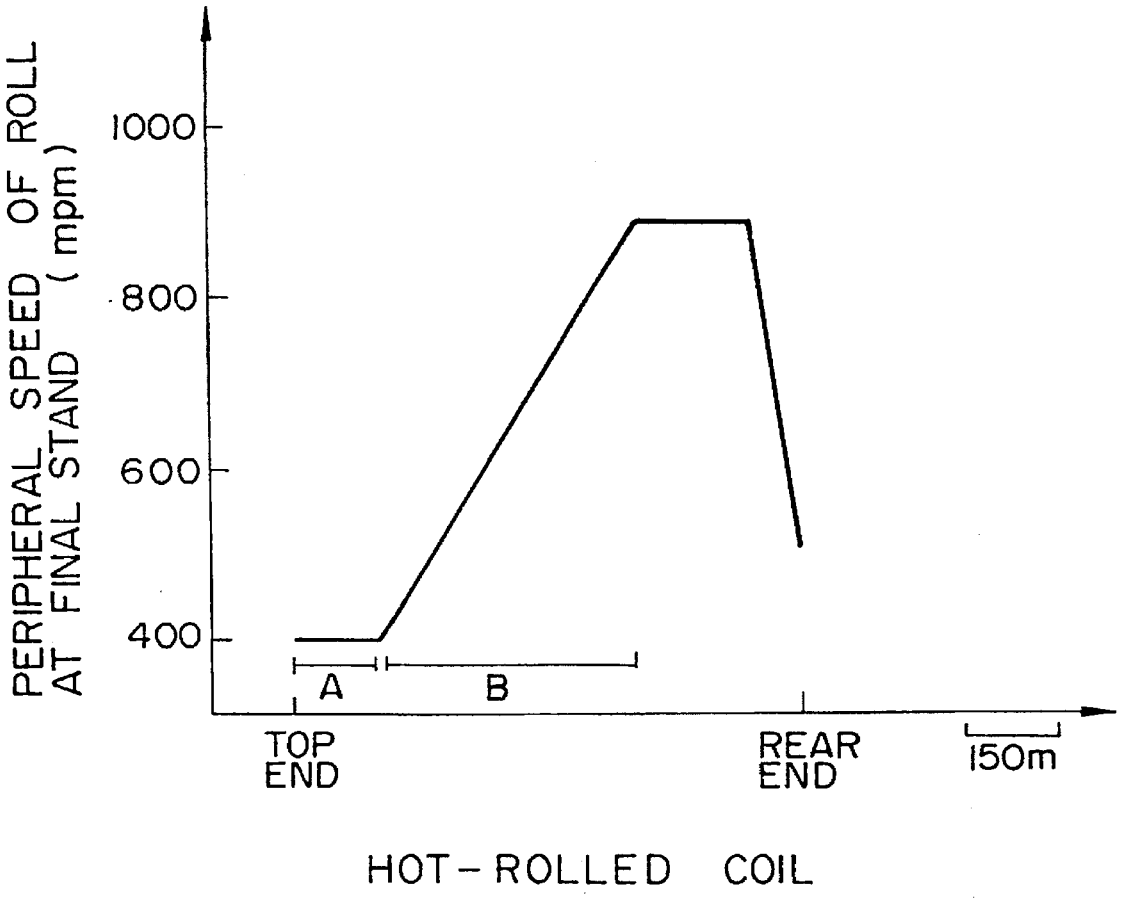
FIG. 1 PRIOR ART
FIG. 1 shows the relationship between a hot-rolled coil and peripheral roll speeds at a final stand during finish rolling according to a conventional hot-rolling process.

The changes in peripheral roll speeds at a final stand according to the above-described conventional hot-rolling process are shown in FIG. 1.

The rolling speed is reduced until the top end of the hot-rolled steel strip is taken out of the final stand and allowed to wind on to a coiler (region (A) of FIG. 1). Since there is no tension on the steel strip, the rolling operation is prone to instability. In particular, a low-silicon, non-oriented electromagnetic steel strip is especially susceptible to gamma-alpha transformation during finish rolling and to unstable rolling as compared to ordinary steels.

After winding over the coiler (region (B) of FIG. 1), rolling speeds were accelerated to increase production efficiency.

Figure 2:
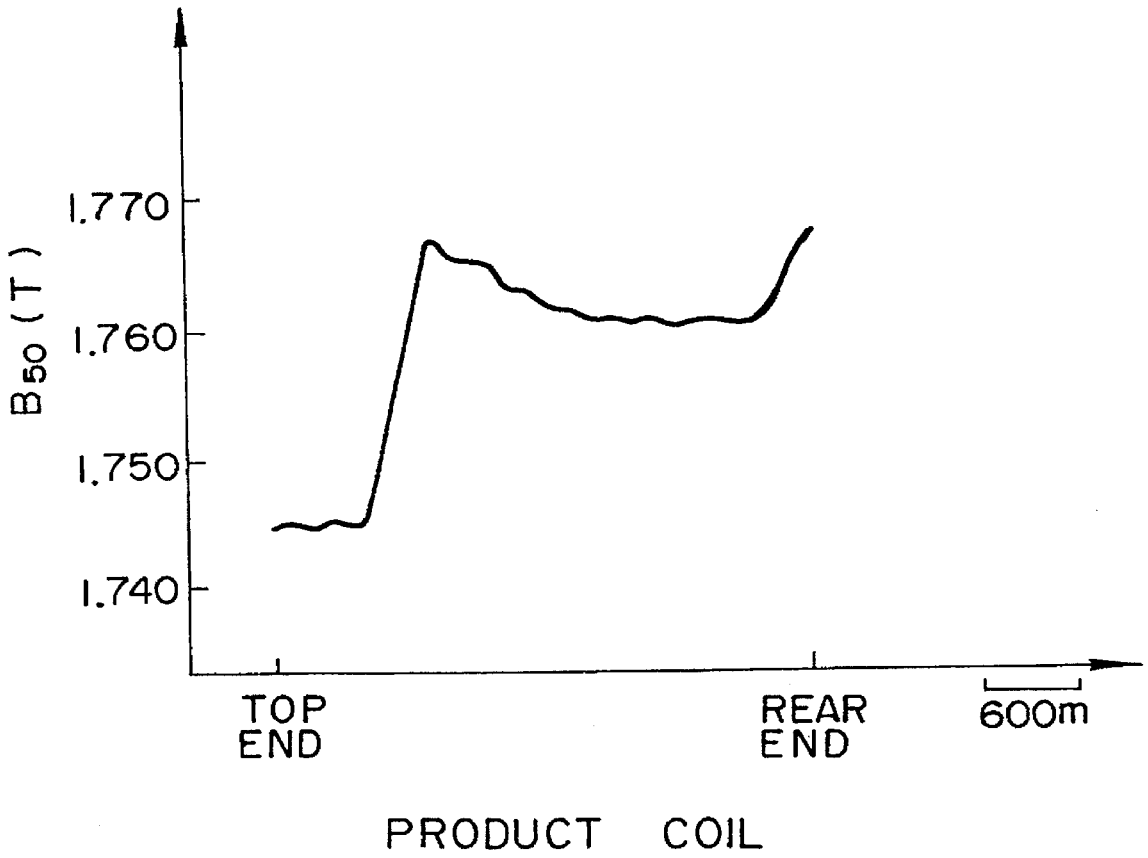
FIG. 2 PRIOR ART
FIG. 2 shows magnetic flux densities of a product coil produced by a conventional hot-rolling process.

FIG. 2 shows the change in magnetic flux density that occurs in a product Coil obtained by the above-described conventional hot-rolling process. As clearly seen in FIG. 2, magnetic flux density generally correlates with rolling speeds. A combination of FIG. 2 with FIG. 1 reveals that when the peripheral speed of a roll does not exceed about 500 mpm at the final stand, magnetic flux density sharply declines.

Figure 3A:
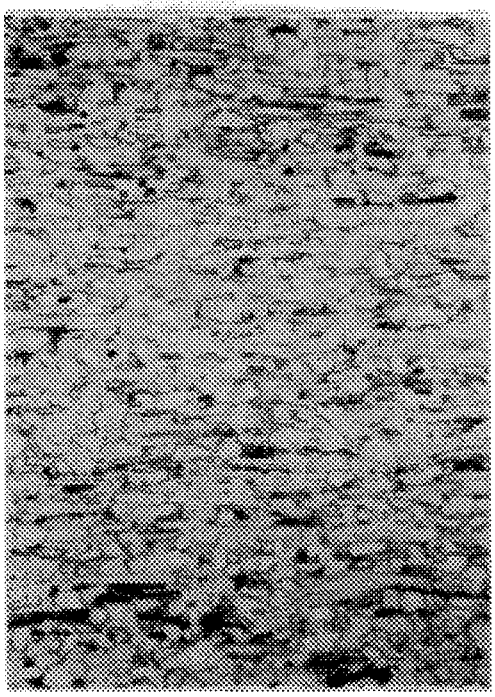
FIGS. 3A and 3B are photographs, seen cross-sectionally, of the metallic structure of a hot-rolled steel strip after hot rolling according to the present invention.
Figure 3B:
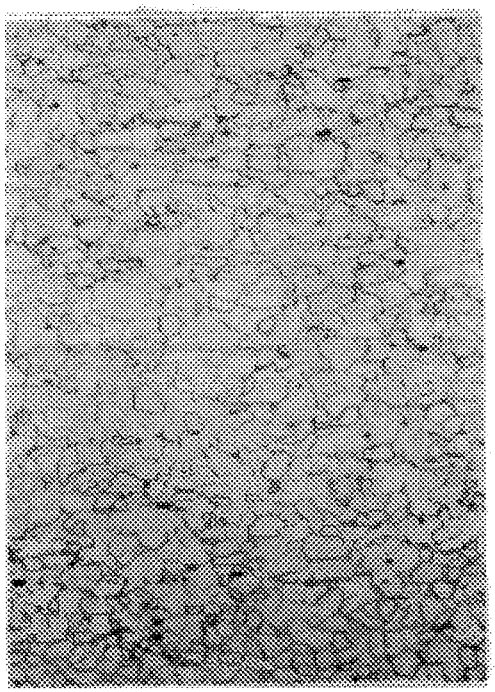

To better understand this deterioration in magnetic flux density, the cross-sectional metallic structure of the steel strip was microscopically examined after finish annealing. FIG. 3A shows the metallic structure in the case of a peripheral roll speed of 400 mpm at the final stand, and FIG. 3B shows the case which involved a peripheral roll speed of 800 mpm. Many unrecrystallized residues can be seen in FIG. 3A, while FIG. 3B reveals coarsely recrystallized grains with no or few such residues. Where the peripheral roll speed is not greater than about 500 mpm at the final stand, those unrecrystallized residues are thought to deteriorate the magnetic flux density. Even if the peripheral roll speed is above about 500 mpm at the final stand, variability in magnetic quality may still be observed due to changes in peripheral roll speeds, as is apparent from FIGS. 1 and 2.

In order to produce a non-oriented electromagnetic steel strip of excellent magnetic quality which is also capable of uniformly retaining that quality in a product coil, we discovered from our investigations that higher rolling speeds during hot rolling are especially advantageous. Specifically, peripheral roll speeds not lower than about 500 mpm at the final stand enable uniform retention of magnetic quality, and the peripheral roll speed should be held constant while hot rolling is being effected.

We have also conducted experiments in which a top end of a "trailing" coarse-rolled sheet bar was attached to a rear end of a "leading" sheet bar to be finish rolled in advance of the trailing sheet bar, each of the sheet bars thereafter being continuously hot-finish rolled. This mode of hot rolling enables tensioning of the steel strip from the outset during finish rolling, thus providing constant and high rolling speeds. The experiments and results were conducted as follows.

Six steel slabs, each composed of 0.003% by weight of C, 0.3% by weight of Si, 0.15% by weight of Mn and 0.2% by weight of Al, were subjected to heating at 1,150° C. and then to 6 coarse-hot rollings to obtain six sheet bars. The rear end of a leading sheet bar and the front end of a trailing sheet bar were initially created by severing the slabs, and then were welded together. Finish rolling was performed by a tandem finish-rolling device comprised of 7 stands, after which a 2.0 mm thick, hot-rolled coil was obtained. In the finish-rolling operation, the temperature at which hot rolling was completed was 800° C., the take-up temperature of the hot-rolled steel strip was 550° C. and the peripheral roll speed at the final stand ranged from a constant 300 to 1500 mpm from the top to rear ends. After being pickled, the hot-rolled steel strip was cold rolled to a thickness of 0.5 mm, followed by finish annealing of at 780° C. for 30 seconds. Magnetic qualities were then evaluated.

Figure 4:
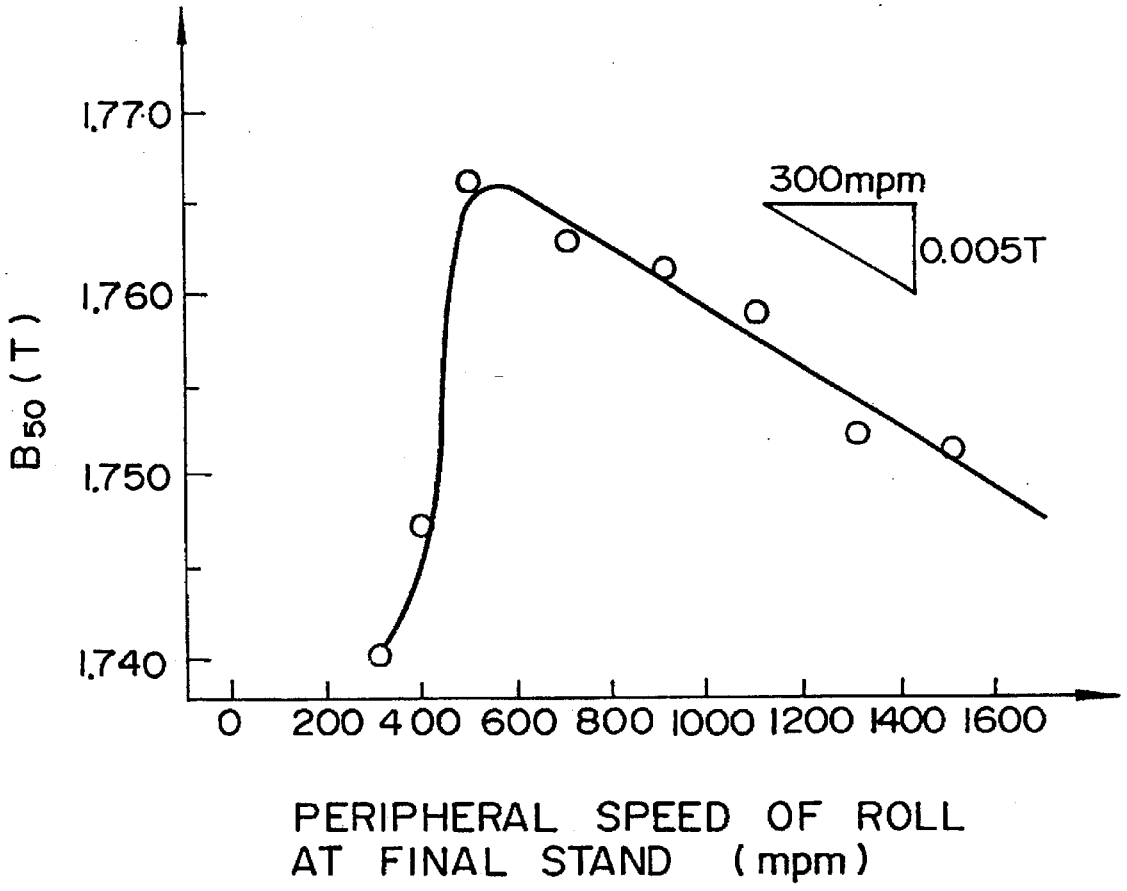
FIG. 4 shows the relationship between the peripheral roll speed at a final stand during finish rolling and the magnetic flux density.
Figure 5:
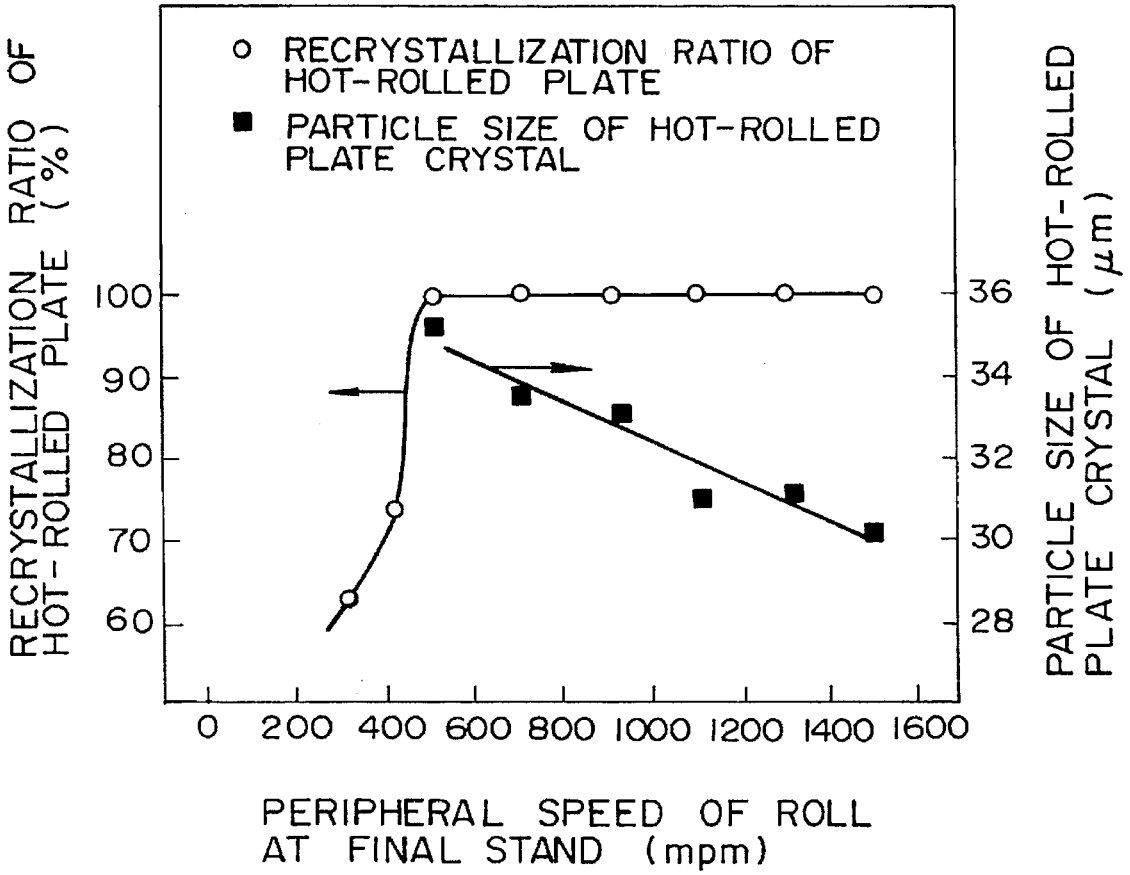
FIG. 5 shows the relationship between the peripheral roll speed at a final stand during finish rolling, the recrystallization ratio of a hot-rolled steel strip and the crystal grain size of a hot-rolled steel strip.
Figure 6:
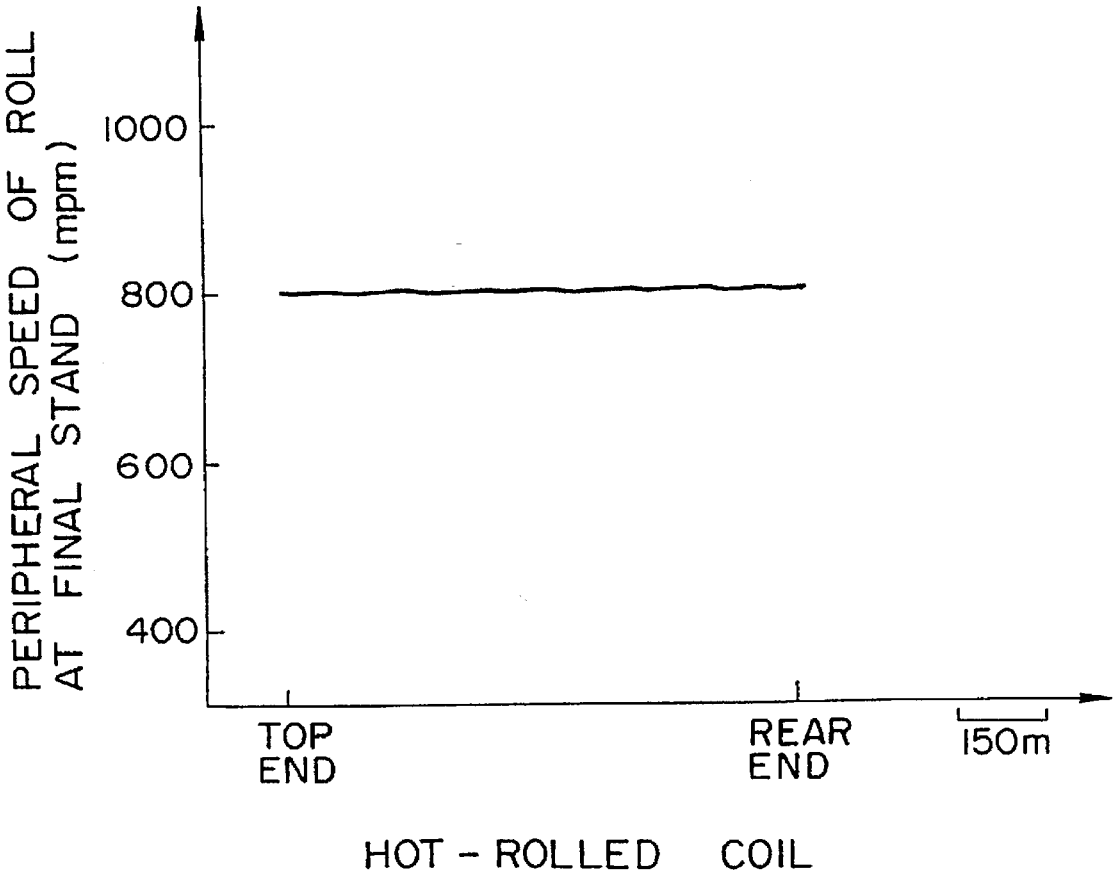
FIG. 6 shows the changes in peripheral roll speed in a hot-rolled coil when the peripheral speed of a roll is set at 800 mpm at a final stand.
Figure 7:
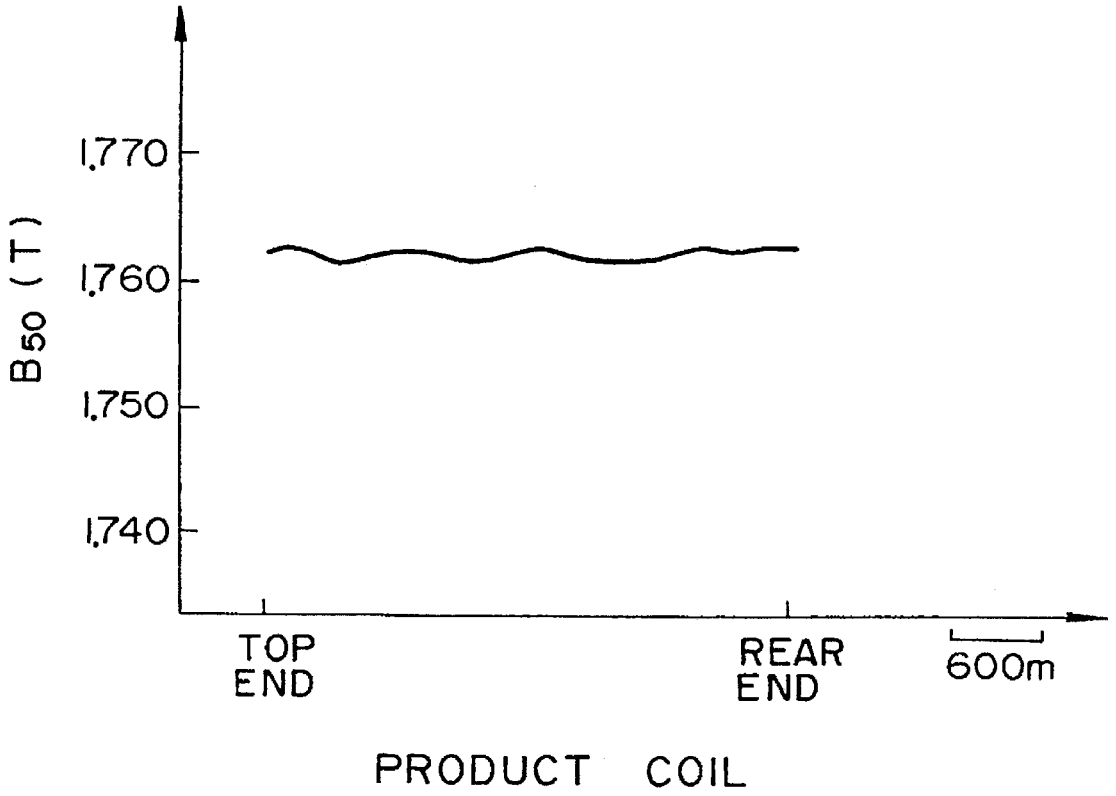
FIG. 7 shows the changes in magnetic flux density in a product coil when the peripheral roll speed is set at 800 mpm at a final stand.

The relationship between the magnetic flux density of the resulting product and the rolling speed during hot rolling (the peripheral speed of a roll at the final stand) is shown in FIG. 4. The relationship between the rolling speed during finish rolling and the recrystallization ratio and crystal grain size of the hot-rolled steel strip is shown in FIG. 5. Shown in FIG. 7 is the change in magnetic flux density in the coil when the constant peripheral speed of a roll at the final stand is 800 mpm, as seen in FIG. 6.

The variation in structure of the hot-rolled steel strip corresponds with the change of rolling speeds. Thus, the change in rolling speeds affects the magnetic quality, as evidenced by FIGS. 4 and 5. Further, constant rolling speeds during finish rolling lead to uniform magnetic quality in the coil as demonstrated by FIGS. 6 and 7.

More specifically, when at least two sheet bars are continuously finish rolled after attaching adjacent rear and front ends prior to finish rolling, constant and high rolling speeds are possible. It is these constant and high rolling speeds that enable a non-oriented electromagnetic steel strip exhibiting excellent magnetic quality and having uniform retention of the magnetic quality in the product coil.

The following mechanism is thought to control how the structure of a hot-rolled steel strip varies depending upon the change of rolling speeds. The frequency of recrystallized nuclei to be formed during recrystallization of a hot-rolled steel strip is thought to be largely affected by the amount of strain accumulated in a steel strip at the time of hot rolling; that is, the greater the strain, the more frequent the formation of recrystallized nuclei. Thus, the amount of strain accumulated would be greater as the rolling speed increases. In the case of low rolling speeds (below 500 mpm), the frequency of formation of recrystallized nuclei as well as the ratio of recrystallization are thought to decrease due to low strain accumulation. When a rolling speed is high enough to attain a recrystallization ratio of 100% (above 500 mpm), the recrystallized grain size is reduced presumably because the frequency of formation of recrystallized nuclei increases as rolling speed increases.

The investigations described above have uncovered a strong correlation between the rolling speed, the structure of a hot-rolled steel strip and the magnetic quality of the steel strip. Continuous finish rolling derived from interconnection of sheet bars has been, for the first time, used for electromagnetic steel strips such that a novel constant- and high-speed hot rolling technology has been discovered for such a steel strip.

A process will now be described in detail to illustrate the present invention defined in the appended claims.

Through the use of steel processing and subsequent mass formation-mass separation or casting, all of which are well-known in the art, a steel slab is prepared comprising less than about 0.03% by weight of C, less than about 3% by weight of Si and less than about 2% by weight of Al such that the equation [Si wt %]+3 [Al wt %]−6 [C wt %] is in the range of about 0 to 2. The contents of C, Si and Al should be strictly observed, as specified above, to preclude quality deterioration. Contents of C greater than about 0.03% would lead to extremely reduced magnetic quality due to magnetism termination. Si and Al increase specific resistance and improve iron loss, but excessive amounts of Si and Al would cause a reduction in the magnetic flux density.

The invention is directed to enhancing the magnetic quality of a low-silicon content, non-oriented electromagnetic steel strip that is subjected to gamma-alpha transformation during hot rolling. The content of the steel strip satisfies the equation about $0 \leqq$ [Si wt %]+3 [Al wt %]−6 [C wt %] $\leqq$ about 2. A value less than about 0 would provide a low point of gamma-alpha transformation, thereby failing to allow such transformation to take place during hot rolling (the transformation would occur only after hot rolling). A value greater than about 2 would allow the retention of a single alpha-phase in any temperature zone, thus bringing about no gamma-alpha transformation during hot rolling.

The steel slab, having a content satisfying the above relation, is thereafter hot rolled into a hot-rolled steel strip. Importantly, hot rolling should be performed with a peripheral roll speed at the final stand during finish rolling of about 500 to 1,500 mpm per coil, with the difference between the maximum and minimum peripheral speeds ranging between about 0 to 300 mpm.

Peripheral roll speeds below about 500 mpm would not sufficiently facilitate recrystallization of the hot-rolled steel strip, resulting in impaired magnetic quality. Peripheral roll speeds above about 1,500 mpm would render rolling itself difficult if not impossible. Particularly preferred is a peripheral speed in the range of about 550 to 1,000 mpm.

A peripheral roll speed range per coil of more than about 300 mpm would render the metallic structure largely irregular in the coil, thereby preventing uniform magnetic quality. A range no greater than about 100 mpm is particularly preferred.

The following means may preferably be employed to attain the peripheral roll speed at the final stand as specified above. Between a coarse-hot rolling device and a finish-hot rolling device, the front end of a trailing sheet bar and the rear end of a leading sheet bar can be attached. Thereafter, the two sheet bars are continuously finish-hot rolled. This attachment may be accomplished by welding by any known means, such as direct transmission heating, induction heating or the like. Particularly preferred is an induction heating method in which the rear and front ends of the leading and trailing sheet bars are disposed adjacent to each other, and alternate magnetic fields are then applied in the thickness direction of each sheet bar. This method permits heating for a shorter period of time, with the sheet bars and the heating device not having to contact each other.

In addition, the temperature at which hot rolling is completed is in an alpha-phase temperature zone. If this temperature were in a gamma-phase zone, the resulting hot-rolled structure would become too minute, leading to impaired magnetic quality. If finish rolling is concluded at too low a temperature even in the alpha-phase temperature zone, the rolling load would increase and, in some cases, make the rolling operation impossible. This is particularly true regarding the present invention in which finish-hot rolling is effected at a higher speed. To avoid the rolling load problem, the temperature Tf (° C.) at which hot rolling is concluded should be not less than about:

$$\{750+30([\text{Si wt }\%]+3[\text{Al wt }\%]-6[\text{C wt }\%])\}.$$

According to the invention, hot rolling may alternatively be completed at a temperature Tf (° C.) which is not less than about:

$$\{750+30([\text{Si wt }\%]+3[\text{Al wt }\%]-6[\text{C wt }\%])\},$$

and not more than about $$\{810+30([\text{Si wt }\%]+3[\text{Al wt }\%]-6[\text{C wt }\%])\}.$$

The relation {750+30 ([Si wt %]+3 [Al wt %]−6 [C wt %])} constitutes the lowest temperature determined by the highest acceptable rolling load. If the temperature Tf (° C.) is lower than the temperature defined by the above relation, greater energy would be required which would increase cost and reduce magnetic quality. The relation {810+30 ([Si wt %]+3 [Al wt %]−6 [C wt %])} denotes a temperature lower by 10° C. than the empirical transformation temperature equation {820+30 ([Si wt %]+3 [Al wt %]−6 [C wt %])}. The reason for the upper temperature limit being defined by a temperature relation 10° C. less than a point of transformation is that at just below the transformation point, hot rolling of the steel strip would get completed in a gamma phase due to irregular temperatures in the skid, particularly in the thickness and widthwise direction of the steel strip. Deteriorated magnetic quality would result in those portions from the completion of hot rolling in a gamma phase.

The take-up temperature should preferably be below about 680° C. Temperatures higher than about 680° C. cause the coil formed from the hot-rolled steel strip to be cooled very irregularly, especially between its inside and outside portions. The cooling irregularities render it difficult to uniformly retain magnetic quality in the coil. In the case of take-up at above about 680° C., the coil may preferably be prevented against irregular cooling from the outside with a hot box.

The hot-rolled steel strip thus obtained, after being pickled where desired, is cold rolled to a given thickness (for example 0.5 mm). In the case of a non-oriented electromagnetic steel strip produced by full processing, the cold-rolled steel strip is further finish annealed into a product. From productive and economic standpoints, finish annealing may preferably be of a continuous type. After finish annealing, insulation may, of course, be applied in a known manner. After finish annealing and insulation coating, skin-pass rolling may be conducted to obtain a semi-processed electromagnetic steel strip. This skin-pass rolling is advantageous in that iron loss can be reduced by strain-removing annealing. The ratio of pressure depression may preferably be in the range of about 1 to 15%. Departures from that range would not allow for sufficiently improved magnetic quality. The semi-processed electromagnetic steel strip may also be obtained after completion of cold rolling or after hot rolling.

with a finish-rolling device composed of 7 stands and under the conditions tabulated in Table 1, whereupon a 2.5 mm steel strip was obtained. The steel strip was thereafter pickled and cold rolled to a thickness of 0.5 mm. Moreover, continuous finish annealing was performed at 800° C. for one minute, and magnetic evaluations were conducted on the steel strip at every 15 m interval. Parts of the specimens were finish annealed and further light rolled, after which strain-removing annealing was effected at 750° C. for 2 hours. Magnetic characteristic evaluations were then conducted.

Each of the non-oriented electromagnetic steel strips thus obtained was evaluated for magnetic quality and uniform retention of that quality in the product coil. The results are shown in Table 1. Nos. 1 to 7 are products which did not undergo skin-pass rolling, while Nos. 8 to 17 did undergo such rolling. As shown in Table 2, Nos. 1, 2, 8, 9, 11, 12 and 17, all inventive examples according to the present invention, uniformly retained excellent magnetic quality in the product coils.

Although this invention has been described with reference to specific forms of apparatus and process steps, equivalent steps may be substituted, the sequence of steps may be varied, and certain steps may be used independently of others. Further, various other control steps may be included, all without departing from the spirit and the scope of the invention defined in the appended claims.

TABLE 1

| | Component (wt %) | | | | Equation * of C, Si and Al | Hot rolling condition: Sheet bar connection | Peripheral speed of roll at final stand (mpm) | | | Temperature at which hot rolling is completed | Pressure drop skin-pass rolling |
|---|---|---|---|---|---|---|---|---|---|---|---|
| | C | Si | Al | Mn | | | max | min | max − min | (°C.) | |
| 1 | 0.003 | 0.10 | 0.0005 | 0.15 | 0.0835 | positive | 700 | 650 | 50 | 805 (α phase) | — |
| 2 | | | | | | positive | 850 | 650 | 200 | 805 (α phase) | — |
| 3 | | | | | | positive | 900 | 550 | 350 | 805 (α phase) | — |
| 4 | | | | | | positive | 700 | 700 | 0 | 890 (γ phase) | — |
| 5 | | | | | | positive | 700 | 700 | 0 | 820 (only skid-γ phase) | — |
| 6 | | | | | | positive | 700 | 700 | 0 | 750 (α phase) | — |
| 7 | | | | | | positive | 600 | 400 | 200 | 805 (α phase) | — |
| 8 | 0.008 | 0.80 | 0.20 | 0.15 | 1.352 | positive | 800 | 700 | 100 | 835 (α phase) | 5 |
| 9 | | | | | | positive | 800 | 800 | 0 | 805 (α phase) | 5 |
| 10 | | | | | | positive | 900 | 550 | 350 | 835 (α phase) | 5 |
| 11 | | | | | | positive | 750 | 750 | 0 | 805 (α phase) | 0.5 |
| 12 | | | | | | positive | 750 | 750 | 0 | 805 (α phase) | 20 |
| 13 | | | | | | positive | 1600 | 1400 | 200 | 805 (α phase) | 5 |
| 14 | | | | | | positive | 700 | 700 | 0 | 1000 (γ phase) | 5 |
| 15 | | | | | | positive | 800 | 800 | 0 | 855 (only skid-γ phase) | 5 |
| 16 | | | | | | positive | 800 | 800 | 0 | 775 (α phase) | 5 |
| 17 | | | | | | positive | 1400 | 1400 | 0 | 805 (α phase) | 5 |

*[Si wt %] +3[Al wt %] − 6[C wt %]

EXAMPLES

The invention will now be described through illustrative examples. It is understood that the examples are not intended to limit the scope of the invention defined in the appended claims.

Slabs of the compositions shown in Table 1 were prepared by continuous casting after the components were adjusted in a converter and a degassing device. The slabs were reheated at 1,100° C. and then hot rolled into sheet bars. Prior to finish rolling, a rear end of a leading sheet bar and a front end of a trailing sheet bar were welded together and finish rolled

TABLE 2

| No. | Magnetic flux density of coil, $B_{50}$(T) max | min | max − min | Remark |
|---|---|---|---|---|
| 1 | 1.765 | 1.763 | 0.002 | Inventive Example |
| 2 | 1.765 | 1.761 | 0.004 | Inventive Example |
| 3 | 1.768 | 1.760 | 0.008 | Comparative Example |
| 4 | 1.728 | 1.725 | 0.003 | Comparative Example |

TABLE 2-continued

| No. | Magnetic flux density of coil, $B_{50}$(T) max | min | max − min | Remark |
|---|---|---|---|---|
| 5 | 1.768 | 1.725 | 0.043 | Comparative Example |
| 6 | excessive load during hot rolling, hot rolling impossible | | | Comparative Example |
| 7 | 1.768 | 1.748 | 0.020 | Comparative Example |
| 8 | 1.753 | 1.751 | 0.002 | Inventive Example |
| 9 | 1.753 | 1.751 | 0.002 | Inventive Example |
| 10 | 1.756 | 1.747 | 0.009 | Comparative Example |
| 11 | 1.745 | 1.743 | 0.002 | Inventive Example |
| 12 | 1.747 | 1.745 | 0.002 | Inventive Example |
| 13 | excessive load during hot rolling, hot rolling impossible | | | Comparative Example |
| 14 | 1.725 | 1.723 | 0.002 | Comparative Example |
| 15 | 1.755 | 1.748 | 0.007 | Comparative Example |
| 16 | excessive load during hot rolling, hot rolling impossible | | | Comparative Example |
| 17 | 1.743 | 1.741 | 0.002 | Inventive Example |

What is claimed is:

1. A process for the production of a non-oriented electromagnetic steel strip having its magnetic characteristics uniformly retained in a product coil, which comprises the steps of:

preparing a steel slab containing not more than about 0.03% by weight of C, not more than about 2.18% by weight of Si and not more than about 2% by weight of Al such that the equation [Si wt %]+3 [Al wt %]−6 [C wt %] is in the range of about 0 to 2;

hot rolling said steel slab to form a hot rolled steel strip, said hot rolling comprising a finish rolling where, at a final roll stand, the steel is rolled at a peripheral roll speed between about 500 to 1,500 mpm, with the difference between the maximum and minimum peripheral roll speeds ranging between about 0 to 300 mpm, said hot rolling being completed at a temperature Tf (° C.) which is in an alpha-phase temperature zone and not less than about {750+30 ([Si wt %]+3 [Al wt %]−6 [C wt %])}; and cold rolling said hot rolled steel strip.

2. The process according to claim 1, wherein said hot rolling is completed at a temperature Tf (° C.) not less than about {750+30 ([Si wt %]+3 [Al wt %]−6 [C wt %])} and not more than about {810+30 ([Si wt %]+3 [Al wt %]−6 [C wt %])}.

3. The process according to claim 1 or 2, wherein said difference between the maximum and minimum peripheral roll speeds at said final roll stand during said finish rolling ranges between about 0 to 100 mpm.

4. The process according to claim 1 or 2, wherein said hot rolling further comprises a coarse hot rolling preceding said finish rolling, and wherein between said coarse hot rolling and said finish rolling, a front end of a trailing coarse-rolled steel slab and a rear end of a leading coarse-rolled steel slab are attached, said attached coarse-rolled steel slabs thereafter being continuously subjected to said finish rolling.

5. The process according to claim 3, wherein said hot rolling; further comprises a coarse hot rolling preceding said finish rolling, and wherein between said coarse hot rolling and said finish rolling, a front end of a trailing coarse-rolled steel slab and a rear end of a leading coarse-rolled steel slab are attached, said attached coarse-rolled steel slabs thereafter being continuously subjected to said finish rolling.

6. The process according to claim 1 or 2, further comprising, after said cold rolling, at least one process step selected from the group consisting of finish annealing and skin-pass rolling.

* * * * *